United States Patent [19]

Miyashita et al.

[11] Patent Number: 4,676,949

[45] Date of Patent: Jun. 30, 1987

[54] METHOD OF PRODUCING METAL SINTERS

[75] Inventors: Tsuneo Miyashita; Hiroaki Nishio, both of Yokohama, Japan

[73] Assignee: Nippon Kokan Kabushiki Kaisha, Tokyo, Japan

[21] Appl. No.: 907,980

[22] Filed: Sep. 16, 1986

[30] Foreign Application Priority Data

Sep. 26, 1985 [JP] Japan ..... 60-211083

[51] Int. Cl.[4] ..... B22F 1/00

[52] U.S. Cl. ..... 419/32; 419/31; 419/34; 419/37; 419/38; 419/54; 419/58

[58] Field of Search ..... 419/31, 32, 34, 37, 419/38, 54, 58

[56] References Cited

U.S. PATENT DOCUMENTS

| | | | |
|---|---|---|---|
| 3,901,742 | 8/1975 | Facaros | 419/37 |
| 3,917,149 | 11/1975 | Breton et al. | 419/9 |
| 4,121,928 | 10/1978 | Mori | 419/6 |
| 4,194,040 | 3/1980 | Breton et al. | 419/32 |
| 4,214,905 | 7/1980 | Sliney | 419/10 |
| 4,365,995 | 12/1982 | Mori | 419/6 |
| 4,391,772 | 7/1983 | Bonnor et al. | 419/37 |

*Primary Examiner*—Stephen J. Lechert, Jr.

*Attorney, Agent, or Firm*—Fleit, Jacobson, Cohn & Price

[57] ABSTRACT

A tetrafluoroethylene-type fluoroplastic powder is added and mixed with a metal powder and the mixture is shaped. The compact is heated in a nonoxidizing atmosphere and the oxides on the surface of the metal particles are converted and removed as gaseous fluorides. Alternatively, after the oxides are converted to solid or liquid fluorides, the fluorides are reduced by hydrogen and then they are removed as gaseous reaction products. Thereafter, the compact is sintered.

5 Claims, No Drawings

METHOD OF PRODUCING METAL SINTERS

BACKGROUND OF THE INVENTION

1. Field of the Invention

The present invention relates to a metal sinter production method for forming and sintering metal powders.

2. Description of the Prior Art

The powder metallurgical industry has expanded into the sintering field of titanium alloys and hard metals from the conventional irons, low-alloy steels and high-alloy steels.

While the powder metallurgy has developed aiming at the production of components which are difficult to make from ingot materials or at the elimination of cutting operations, in the field if melting and casting any improvement in the performance of metal materials has required an increase in the amount of the solute constituent with the inevitable deterioration of the performance due to segregation of the solute constituent and thus the powder metallurgical techniques have been noted as means of solving the problem.

Under present circumstances, however, the powder metallurgical industry has not grown as expected.

Some causes are conceivable for this situation and for one thing the properties of a raw powder must be considered to constitute a cause. In other words, the performance of a powder metallurgical product is largely dependent on the properties of the raw powder. Of the properties of the raw powder, the oxygen content is the most serious problem. Oxygen is usually present in the form of an oxidation coating on the surface of the metal particles and it impedes the sintering of the metal particles. Thus, the resulting sinter fails to exhibit satisfactory mechanical properties.

It has been known to add chromium, manganese, silicon, aluminum, titanium, vanadium and the like to improve the mechanical properties of a sinter. Many of these addition elements are high in affinity for oxygen so that the raw powder tends to be oxidized easily during its production and handling and, once oxidized, its reduction is difficult. Thus, the alloying elements remaining in the form of oxides rather deteriorate the mechanical properties of the sinter.

For instance, Mn-Cr type low-alloy steels, the most widely used low-alloy steels for mechanical structural purposes, usually contain oxygen in the range between 1500 and 5000 ppm and therefore their quenching properties are deteriorated considerably by their oxygen contents.

While the silicon content is kept low in any of these low-alloy steels, this is due to the difficulty to reduce the silicon carbides in the raw powder by the ordinary solid reduction and as a result the application of silicon to the powder metallurgy is limited considerably.

For instance, a stainless steel powder contains reactive elements such as chronium and silicon and the inexpensive water spray process is used for its production thus frequently resulting in the oxygen content of 1000 to 2500 ppm. However, the reducing treatment of the powder is not easy and the powder is frequently used in its form just resulting from the water spraying. Thus, the resulting oxides, such as, $SiO_2$ formed on the surface of the particles cause the occurrence of necking during the initial period of the sintering and they also retard the subsequent material transfer. Also, such oxides remain in the form of pseudo grain boundaries and inclusions in the sinter and they also deteriorate such properties as tensile strength, ductility and toughness.

For instance, a nickel-base hard metal powder contains reactive metals such as chromium, titanium and aluminum in large amounts so that a non-contaminating spray-process, e.g., an argon gas spraying is used and the oxygen content is reduced to less than one tenth of that obtained by the water spraying. However, the occurrence of pseudo grain boundaries by the oxidation of the surface of the particles and the like is still a problem as a cause of defects in the sinter.

This problem is more serious in the case of titanium alloys. The reason is that the principal constituents consist of reactive elements as in the case of a Ti-6Al-4V alloy.

As described hereinabove, the state of things is such that in the manufacture of sinters of metals such as irons, low-alloy steels, stainless steels, hard metals and titanium alloys as well as high-speed steels, tool steels, mar-aging steels and magnetic alloys, the surface oxidation of a raw powder causes the occurrence of sintering defects thus failing to fully derive the mechanical properties of the material which should primarily be obtained. It is also known that the surface oxidation of raw powders results in deteriorated magnetic properties in the case of magnetic alloys.

SUMMARY OF THE INVENTION

It is the primary object of the present invention to provide a method of producing metal sinters which is capable of preventing the occurrence of oxides on the surface of particles of a raw powder forming a compact to be sintered.

To accomplish the above object, in accordance with one aspect of the invention there is thus provided a method of producing metal sinters which features, in the course of the sequential performance of the steps of mixing a raw metal powder and a solid lubricant powder, shaping the mixed powder and sintering the compact, the steps of mixing a fluoroplastic powder with the metal powder during the mixing step, heating the compact in a nonoxidizing atmosphere prior to its sintering so as to convert the oxides on the surface of the metal particles to metal fluorides by the thermal decomposition gas of the fluoroplastic, and removing the undesired products of the conversion reaction in the form of gases from the compact prior to its sintering.

Where the conversion reaction products including metal fluorides are in the form of gaseous matters, the removal of the gaseous products is accomplished by subjecting the compact to a reduced pressure. There are cases where the metal fluorides are solids and in such a case the compact is heated under a reduced pressure thereby sublimating or vaporizing the solid metal fluorides and converting them into gases. Where the gasification of the solid metal fluorides by the heating under a reduced pressure is difficult, the compact is subjected to a reduced pressure thereby removing the conversion reaction products in gaseous form and then the solid metal fluorides are reduced by hydrogen under the application of heat to convert them to metals and thereby remove the fluoride hydrogen gas produced by the reduction reaction.

Thus, in accordance with the invention the oxides are no longer present on the surface of the metal particles prior to the sintering of the compact and therefore the mechanical properties of the metal sinter obtained by the sintering are excellent ones fully utilizing the essential properties of the material. cl DETAILED DESCRIPTION OF THE INVENTION In accordance with the invention, the term metal powder is a general term for single-component metal powders, mixed powders of different metals, alloy powders of different metals and alloy powders containing oxides, nitrides or borides.

Suitable fluoroplastics to be mixed with this metal powder are those containing tetrafluoroethylene as its basis and as for example, a powder of polytetrafluoroethylene resin (PTFE), tetrafluoroethylene-hexafluoropropylene copolymer resin (FEP), tetrafluoroethylene-perfluoroalkylvinylether copolymer resin (PFA) or tetrafluoroethylene-ethylene copolymer (ETFE) may be used as a part or whole of the required solid lubricant.

When such fluoroplastic is heated under a reduced pressure, the material is thermally decomposed at a temperature of over 350° C. producing a gas principally consisting of tetrafluoroethylene ($C_2F_4$). For example, when the polytetrafluoro-ethylene resin is thermally decomposed under the conditions of 600° C. and 70 Torr, a gas having the composition of $C_2F_4$ 83% and $C_3F_6$ 17R is produced. At temperature above 400° C. the tetrafluoroethylene gas reacts with various metal oxides thus converting them to metal fluorides. For instance, when silica is contacted with the tetrafluoroethylene gas at 600° C., a gaseous silicon fluoride is produced according to the following chemical reaction formula $$SiO_2(S)+C_2F_4(g)\rightarrow SiF_4(g)+2CO(g)$$

where (S) denotes a solid and (g) denotes a gaseous matter. In the like manner, titanium oxide can be converted to a gaseous titanium fluoride in the following manner $$TiO_2(S)+C_2F_4\rightarrow TiF_4(g)+2CO(g)$$

In the case of alumina, it can be converted to a solid aluminum fluoride as follows:

$$\frac{2}{3}\,Al_2O_3(S) + C_2F_4(g) \longrightarrow \frac{4}{3}\,AlF_3(S) + 2CO(g)$$

This solid aluminum can be easily sublimated by heating it at 800° C. in a vacuum of 0.01 Torr.

Also, in the case of manganese oxide, a solid manganese fluoride can be produced at 600° C. according to the following formula $$2MnO(S)+C_2F_4(g)\rightarrow 2MnF_2(S)+2CO(g)$$

While the melting point of this solid manganese fluoride is 856° C., manganese fluoride which is solid or liquid at 850° to 900° C. can be easily converted to a gaseous manganese fluoride by maintaining a vacuum of $10^{-3}$ Torr.

Nickel oxide is converted to a solid nickel fluoride at 600° C. and it is easily converted to a gaseous nickel fluoride under the conditions of 900° C. and 0.01 Torr.

Chromium oxide and iron oxide are similarly converted to solid fluorides according to the following formulas $$2FeO(S) + C_2F_4(g) \longrightarrow 2FeF_2(S) + 2CO(g)$$

$$\frac{2}{3}\,Cr_2O_3(S) + C_2F_4(g) \longrightarrow \frac{4}{3}\,CrF_3(S) + 2CO(g)$$

While these solid fluorides cannot be sublimated even by heating them up to 1000° C., they can be converted to metals by a hydrogen reduction at temperatures above 800° C. according to the following chemicals reaction formulas $$FeF_2(S) + H_2(g) \longrightarrow F_2(S) + 2HF(g)$$

$$\frac{2}{3}CrF_3(S) + H_2(g) \longrightarrow \frac{2}{3}Cr(S) + 2HF(g)$$

As mentioned hereinabove, oxides of such reactive metals as silicon, titanium, aluminum, manganese and chromium can be converted to fluorides by the use of a tetrafluoroethylene gas so as to remove them in the form of gaseous fluorides or alternatively solid or liquid fluorides can be converted to metals by the reduction in hydrogen. The similar treatment can be performed on iron, nickel, etc., serving as basic metals of alloys.

When the tetrafluoroethylene-ethylene copolymer resin is thermally decomposed, a hydrogen fluoride is produced in addition to a tetrafluoroethylene. This hydrogen fluoride also acts effectively in the fluoridization reaction of the previously mentioned oxides.

To utilize the above-mentioned action of the thermal decomposition gas of the tetrafluoroethylene-type fluoroplastic in the removal or reduction of the oxides on the surface of metal particles constitutes a feature of the invention.

The friction coefficient of the tetrafluoroethylene resin is as low as less than 0.1 and it has excellent lubricating properties. Usually, a powdered stearic acid or metallic stearate such as zinc stearate is used as a solid lubricant for metal powder shaping purposes. A second feature of the invention is to use a powdered tetrafluoroethylene resin as a solid lubricant in place of the conventional lubricants.

In other words, the invention features that a powdered tetrafluoroethylene-type fluoroplastic is mixed with a metal powder to serve as a solid lubricant during shaping, that the resulting compact is heated in a nonoxidizing atmosphere so that a tetrafluoroethylene gas, etc., are produced by thermal decomposition of the tetrafluoroethylene-type fluoroplastic and the thermal decomposition gas is used to convert the oxides on the surface of the metal particles forming the compact to gaseous fluorides and remove as such or convert the oxides to solid or liquid fluorides, reduce the fluorides by hydrogen and then remove as gaseous reaction products thereby cleaning the surface of the metal particles and that the thus cleaned compact is sintered thereby producing a sinter which has less sintering defects and is excellent in mechanical properties.

The present invention will now be described further by the following example in conjunction with the corresponding comparative example.

EXAMPLE

The powder of the AISI 4100 Mn-Cr type low-alloy steel shown in the following Table 1 was used as a raw powder. It is to be noted that the oxygen content of the powder was 3800 ppm.

TABLE 1

| Composition of Mn—Cr Low-Alloy Steel (Weight %) | | | | | |
|---|---|---|---|---|---|
| C | Si | Mn | Cr | Mo | O |
| 0.18 | 0.04 | 0.63 | 1.06 | 0.24 | 0.38 |

After adding 1.6 weight % of finely powdered tetrafluoroethylene resin and 0.4 weight % of graphite to the raw powder and mixing them for 1 hour in a V-type mixer, a test specimen of 10 mm square×55 mm long was formed by a single screw press so as to obtain a compact density of 7.1 g/cm$^3$. The compact was placed in a tubular furnace thereby heating it to 300° C. and then the furnace was closed after evacuating the furnace to attain a vacuum of $10^{-3}$ Torr. Then, after increasing the temperature of the compact to 600° C. and holding it thereat for 30 minutes, increasing the temperature to 900° C. and evacuating the furnace up to $10^{-3}$ Torr, hydrogen (dew point of −40° C.) was introduced into the furnace and the compact was held at 900° C. for 30 minutes in the hydrogen stream. Then, after evacuating the furnace up to $10^{-3}$ Torr, hydrogen was introduced into the furnace and the compact was sintered at 1150° C. for 30 minutes in the hydrogen atmosphere. The test specimen showed a transverse strength of 138 Kgf/mm$^2$ and an impact resistance value of 3.2 Kgf/mm$^2$ and its mechanical properties were improved considerably as compared with those of the below-mentioned comparative example.

COMPARATIVE EXAMPLE

The powdered AISI 4100 Mn-Cr type low-alloy steel shown in Table 1 was used as a raw powder as in the case of the above-mentioned Example. After adding 0.8 weight % of zinc stearate and 0.4 weight % of graphite to the raw powder and mixing them together for 1 hour in a V-type mixer, a test specimen of 10 mm square×55 mm long was formed to attain a compact density of 7.1 g/cm$^3$ by a single screw press and the compact was degreased by holding it at 600° C. for 30 minutes in a nitrogen atmosphere. Then, the compact was sintered at 1150° C. for 30 minutes in a hydrogen atmosphere having a dew point of −40° C. in a tubular furnace. The test specimen showed a transverse strength of 112 Kgf/mm$^2$ and an impact resistance value of 1.8 Kgf/cm$^2$.

We claim:

1. In a metal sinter production method including the steps of mixing a solid lubricant powder with a metal powder, shaping the mixed powder and sintering the resulting compact, the improvement comprising the steps of:

mixing a fluoroplastic powder with said metal powder during said mixing step;

heating said compact in a nonoxidizing atmosphere prior to the sintering thereof;

converting oxides on the surface of particles of said metal powder to metal fluorides by reaction with a thermal decomposition gas of said fluoroplastic produced by said heating; and removing undesired products of said conversion reaction in the form of gaseous matters from said compact prior to the sintering thereof.

2. A method according to claim 1, wherein said fluoroplastic comprises a tetrafluoroethylene-base fluoroplastic.

3. A method according to claim 1, wherein said oxides are converted to gaseous metal fluorides by reaction with said thermal decomposition gas, and said gaseous metal fluorides are removed by evacuation.

4. A method according to claim 1, wherein said oxides are converted to solid metal fluorides by reaction with said thermal decomposition gas, and said solid metal fluorides are gasified by heating the same under a reduced pressure thereby removing said gasified metal fluorides by evacuation.

5. A method according to claim 1, wherein said oxides are converted to solid metal oxides by reaction with said thermal decomposition gas, and said solid metal fluorides are reduced by hydrogen under the application of heat thereby reconverting the same to metals whereby gases produced by said reduction reaction are removed by evacuation.

* * * * *